United States Patent [19]

Walbröhl

[11] Patent Number: 4,830,535

[45] Date of Patent: May 16, 1989

[54] KNIFE SHIELD DRIVING DEVICE AND METHOD FOR THE EXCAVATING AND/OR FINAL SUPPORTING OF GALLERIES OR THE LIKE

[76] Inventor: Heinz-Theo Walbröhl, Nordstr. 73, D-5300 Bonn 7, Fed. Rep. of Germany

[21] Appl. No.: 91,274

[22] Filed: Aug. 31, 1987

[30] Foreign Application Priority Data

Sep. 1, 1986 [DE] Fed. Rep. of Germany ..... 3629729
Aug. 5, 1987 [DE] Fed. Rep. of Germany ..... 3726038
Aug. 12, 1987 [DE] Fed. Rep. of Germany ..... 3726846

[51] Int. Cl.[4] ..... E21D 9/06

[52] U.S. Cl. ..... 405/145; 405/143; 405/288

[58] Field of Search ..... 405/140, 141, 143, 145, 405/288

[56] References Cited

U.S. PATENT DOCUMENTS 675,355 5/1901 MacHarg ..... 405/143
2,019,295 10/1935 Dolder ..... 405/140
4,155,668 5/1979 Heitkamp et al. ..... 405/145
4,334,800 6/1982 Stuckmann ..... 405/145

FOREIGN PATENT DOCUMENTS 2746349 4/1979 Fed. Rep. of Germany ..... 405/143

*Primary Examiner*—David H. Corbin

*Attorney, Agent, or Firm*—Anthony J. Casella; Gerald E. Hespos

[57] ABSTRACT

The knife-shield driving device consists of drive knives (10, 12, 14, 16, 18) which can be acted on via a pushing device and are guided with respect to each other on their longitudinal sides. The guides consist of guide yokes (20) and wedge elements (30) which are guided in said guide yokes (20). For the change in direction of the driving it is sufficient to select any desired suitable guide knife (14) which is controlled in direction during the driving via hydraulic presses (34, 36) arranged on the adjacent knives (12, 16). In this connection, the guide yoke (20) slides on the wedge element (30) of the adjacent knife (12) and the wedge element of the knife (14) slides in the guide yoke on the knife (16). After removal of the hydraulic presses (34) and (36), the adjacent knives can be driven forward starting in each case, from the directly adjacent knife (12) or (16) respectively, as a result of which, via the guidance of the yokes on the wedge surfaces, an automatic alignment of the knives which are driven forward one after the other is effected with respect to the initial drive knife (14). With the system at rest, i.e. when all knives have been driven forward, the knives are self-supporting as a result of mutual support on the longitudinal sides so that guide arches supporting the knives during the driving can be lowered in order, after forward travel, to again assume the supporting function for the knives which are again to be driven forward.

22 Claims, 8 Drawing Sheets

KNIFE SHIELD DRIVING DEVICE AND METHOD FOR THE EXCAVATING AND/OR FINAL SUPPORTING OF GALLERIES OR THE LIKE

BACKGROUND OF THE INVENTION

The present invention relates to a knife-shield drive device and a method for the excavating and/or final supporting of galleries, tunnels, shafts or similar elongated structures, in which connection knives supported by support frames or guide arches are advanced one after the other and the support frames are moved further forward after the advance of all knives.

From Federal Republic of Germany No. OS 19 66 078 there is known such a device with drive knives which have guides which are rigid with respect to each other and are developed for rigid parallel guidance in the manner of the locks used in channel or sheet-piling. This device has the disadvantage that corrections in direction, which presuppose relative mobility of the individual drive knives with respect to each other, are not feasible or are feasible only with great difficulty. If in these known drive knives the lock clearance is increased, relative mobility of the knives with respect to each other is, it is true, obtained but on the other hand there is the disadvantage that the knives can move uncontrolled within the lock clearance so that precise control is not possible. There is also the disadvantage that upon the advance of the knives jamming frequently occurs in the rigid guides. This is true, in particular, if the knives come against stones in the face or wall and try to move out of their way.

From Federal Republic of Germany No. AS 27 42 332 a method is known in which drive knives which have lateral wedges are used. In that case the individual knives have relative mobility with respect to each other upon their advance, so that curves or corrections in direction can be handled. This known device has the disadvantage, however, that in order to obtain relative mobility for purposes of correction upon the advance all drive knives must always be driven forward in a given sequence, i.e., as a rule, commencing with the roof knife and then proceeding to the right and left of the latter. This structural sequence of the advance of the individual drive knives, which cannot be changed during the driving of the tunnel is disadvantageous if, for instance, in the case of rolling terrain knives must be driven forward in a different sequence in order to secure the breast wall.

In tunnel cross sections having, for instance, vertical side walls, the side knives move away as a result of the force of gravity in the direction towards the floor of the tunnel. This downward motion takes place, in particular, in the case of long and heavy knives, in connection with which the frictional forces between knife and earth, on the one hand, and between the guide arch and knife, on the other hand, are not sufficient to hold the knife in its position. Together with this, there are losses of ground as a result of gaping joints in the knife shield which are produced by the deviating of the knives. Furthermore, knives which have moved downward must be brought back into their old position in expensive manner by the aid of hydraulic presses.

Travel around a curve is very time and labor consuming. If a right-hand curve is to be moved over with the known method and the known apparatus then, to be sure, all knives lying to the right of the roof knife are steered in the desired direction by the action of the wedges applied to the knives but all knives lying to the left of the roof knife must be pushed individually in the desired direction in expensive fashion by, for instance, the aid of hydraulic presses.

From Federal Republic of Germany No. AS 20 21 734 there is known a traveling support scaffolding in which four support frames are connected, in each case, to two nested frame structures. This known arrangement is expensive because of the required frame structures and it requires very long knives with relatively small step. Long knives, however, in addition to a higher expense mean, in particular, a more difficult manipulability upon travel around curves and changes in direction.

From Federal Republic of Germany No. OS 26 18 571 there is known a self-supporting support unit formed of knife boards for small gallery cross sections. The knife boards are guided there at all times rigidly on each other via dovetail-like guides so that changes in direction which presuppose relative mobility of the knives with respect to each other cannot take place. Furthermore, in order to produce a closed ring, knife boards are also arranged on the floor of the tunnel, which greatly impairs the handiness of this known device.

SUMMARY OF THE INVENTION

The object of the present invention is to provide a method and an apparatus by which an excavating and/or final supporting of a gallery or the like is possible without disturbing apparatus parts and expensive support frames, in connection with which a knife-shield driving device can easily be controlled, in connection with which no drive knife is determined as the knife to be driven first, and in connection with which the following up of the other knives can take place without additional measures.

This object is achieved in accordance with the invention in the manner that the guides on the drive knives consist of wedge elements guided in yokes.

In this way assurance is had that a relative movement of the drive knives with respect to each other is possible, that each drive knife can be used as first knife to be driven, and that the other knives, after they have been driven forward, assume, without additional readjusting expense, their position parallel to the first knife driven.

In accordance with one preferred embodiment, the yokes are of U-shape and on the wedge elements there is provided a section the width of which corresponds approximately to the distance apart of the arms of the U-shaped yoke. This section is received by the arms of the U-shaped yoke when all knife ends lie in a plane, i.e. when all knives are driven forward the same distance. In this position all knives have a parallel position and are connected to each other with only slight play. The wedge elements preferably taper towards both ends starting from the section of constant width, which is developed as central section. In this way, assurance is had that the knife to be driven forward first can be steered to the right or left upon the start of the driving movement and that the parallel knives which are then to be driven are swung, by sliding of the surfaces of the wedge elements on the arms of the U-shaped yokes, into the direction of the first knife.

In accordance with preferred embodiments a yoke is provided on one side of each drive knife while a wedge element is arranged on the other side, or a yoke is arranged on each side of every second drive knife and a wedge element is arranged on each side of every intermediate drive knife. In the former case, all drive knives can be of identical development so that the stocking and the replacement of defective drive knives are simplified.

The U-shaped yoke is preferably open towards the top and the wedge element engages from above between the arms of the yoke. The wedge element on each drive knife is preferably fastened via a cantilevered plate on the longitudinal side of the drive knife.

As a further development of the invention, backing wedges are arranged between the U-shaped yoke and the wedge element on the drive knives which are arranged in the region of curvature of a tunnel cross section, so that the position of yoke and wedge element is adapted to the tunnel cross section.

In order to reduce friction between the arms of the yoke and the surfaces of the wedge element and avoid forcing between said parts, the contacting inner surfaces of the yoke arms and the outer surfaces of the wedge element are preferably rounded.

For the control of the knife which is to be driven forward first there is provided in the front region of each drive knife, a means of attachment for a pushing device acting on an adjacent knife. For the control of the driving device of the invention, two pushing units which can be attached via a rapid closure and consist in particular of piston-cylinder units are sufficient. These piston-cylinder units are arranged on the knives adjacent the first knife to be driven so as, by different piston paths, to control the swinging of the said first knife to be driven. The knives which are to be thereupon driven do not require any correction in direction via pushing units since by the sliding of the yokes on the wedge surfaces, or vice versa, they are positively brought into the position parallel to the first knife which is driven forward.

As a further development of the invention, when the system is at rest, the knives rest mutually via lateral support members against each other and are self-supporting without floor-side connection.

In accordance with a preferred embodiment, on one side of each knife there is provided a long support member of T-shaped cross section with downward-directed transverse arm and, on the other side of each knife, there is a short support member of U-shaped cross section with upward-directed arms, the L-shaped support member of one knife engages into the U-shaped support member of an adjacent knife, and wedge-shaped run-on ramps are arranged on the T-shaped support member starting from central sections of constant width. If all knives are driven forward the same distance, the arms of the U-shaped support member rest against the regions of constant width of the T-shaped support member so that the knives are in direction contact with each other. In this way, forces which occur without transverse movement of the knives are introduced up into the floor-side knives and from them into the floor. During the advance of the knives, relative movement of the knives can take place since the wedge-shaped run-on ramps on the T-shaped support member have sufficient play within the U-shaped support member to swing the knives in the desired direction.

In accordance with a preferred embodiment, an adjustable stop element is provided on the U-shaped support member. This stop element can be developed in the form of a screw which, by screwing in and out, permits adjustment of the clearance between the support members.

As a further development of the invention, lift devices which act on the floor-side knives transverse to the longitudinal axis of the knife are provided, they being developed in particular as hydraulic or pneumatic piston-cylinder units. After the advance of all knives, the lift devices are actuated so that each knife can be brought into direct contact with the adjacent knife so that after the lowering of the support yokes no uncontrolled movement of the knives towards the floor can take place. The pressure is then introduced into the floor via the piston-cylinder units.

In accordance with a preferred embodiment, lift devices are arranged on the guide yokes or support frames on the floor-side ends. By means of these lift devices the support yokes can be lowered so that, with the system at rest, i.e. when the knives are self-supporting, the arches can be moved into the new supporting position. After renewed arrangement, lift devices are actuated and the top of the guide arches are brought against the bottom of the knives so that the knives receive the necessary guidance during the advance. The lift devices on the support yokes are preferably hydraulic or pneumatic piston-cylinder units.

So that horizontal forces can be transferred from the support frames or guide arches into the floor, guide elements which engage in guides arranged on floor plates are preferably arranged on the floor-side ends of the support frame. The lift devices for the support frames are preferably arranged on the floor plates, whereby it is made possible that after the retraction of the lift devices upon the lowering of the guide arches the floor plates are raised together with the guides so as to be shifted with the guide arches.

On the floor-side ends of the support frames there are provided braces which preferably are displaceable and engage in guides which can be placed on the floor. Upon the lowering of the guides arches the plates with the guides are thus simultaneously raised and the braces also support rails so that the guide arches which are then no longer in contact with the drive knives can be moved.

Preferably two support frames which are connected by pushing devices are provided. The pushing devices are preferably piston-cylinder units.

A method in accordance with the invention, in particular with the use of a knife shield driving device according to the invention, is characterized by the fact that when the system is at rest or after the advance of all knives the knives are brought into lateral position with respect to each other and are self-supporting, that the support frames are lowered and moved further, and that after lifting of the support frames the knives are again driven forward.

The knives which are supported by the support frames during the driving take over the supporting when all knives have been driven forward, i.e. they directly take up the pressure exerted by the rock and conduct it into the tunnel floor. In this state the guide arches or support frames can be lowered and moved further in order then to take over the supporting when the knives are again advanced. In this procedure, accordingly, it is possible to dispense with a second pair of support frames, which, on the one hand, makes the apparatus more economical and, on the other hand, results in fewer obstacles during the work. Furthermore, the knives can be made shorter so that travel around curves or corrections in direction are easily possible. The knives are supported on both sides on the floor while they assume the support. No knives are arranged over the width of the floor.

BRIEF DESCRIPTION OF THE DRAWINGS

Various embodiments of the invention will be described below with reference to the drawing, in which.

DETAILED DESCRIPTION OF THE PREFERRED EMBODIMENT

Figure 1:
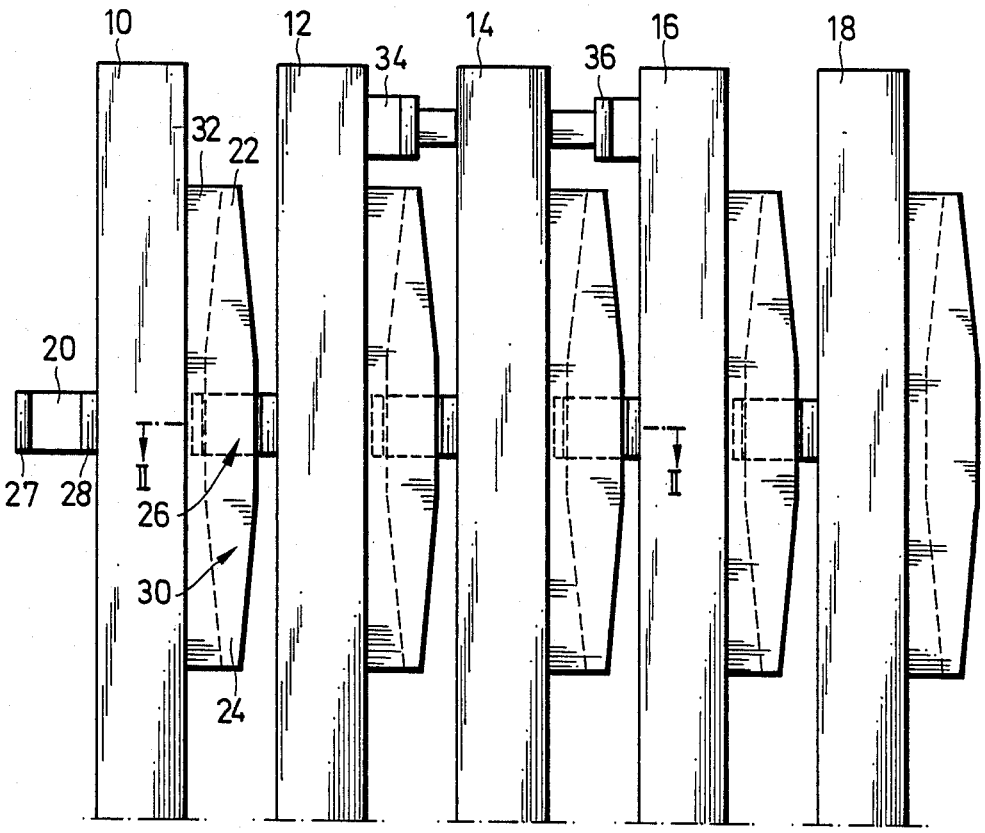
FIG. 1 is a top view of a row of drive knives in a starting position.

FIG. 1 shows a knife shield driving device having an arrangement of drive knives 10, 12, 14, 16, 18. Depending on the cross section to be driven, further drive knives are present adjacent the knives 10 and 18 respectively. Each knife 10 to 18 is provided on its left side with a U-shaped yoke 20 and on its right side with wedge elements 22 and 24. The wedge elements 22 and 24 extend from a central region 26 which is of constant width. From this region 26, the wedge elements 22 and 24 taper down towards their opposite ends. The wedge elements 22 and 24 together with the central section 26 from a longitudinal guide which is guided between the arms 27 and 28 of the U-shaped yoke 20. In the arrangement shown in FIG. 1 the play between the knives 10 to 18 is practically zero since the width of the central section 26 is approximately equal to the distance between the arms 27 and 28 of the U-shaped yoke 20. The guides 22, 24, 26 form a wedge element 30 which is arranged below a cantilevered plate 32 which is fastened to the longitudinal side of a knife 10 to 18. The wedge element 30 engages from above between the arms 27 and 28 of the yoke 20 which is open on the top.

The position of the drive knives 10 to 18 shown in FIG. 1 is the starting position before a new section of driving. It is assumed that the drive knife 14, which may be arranged at any desired point in the cross section of the tunnel, is to be driven forward as first knife. For the lateral guidance of this knife 14, hydraulic presses 34 and 36 in the form of piston-cylinder units are arranged on the knife 12 and the knife 16, adjacent the knife 14, respectively. On each knife 10 to 18 there are provided, on both longitudinal sides, suitable devices for the rapid attachment of such hydraulic presses. Two such hydraulic presses are sufficient for the directionally controlled advance of the drive knives 10 to 18.

Figure 2:
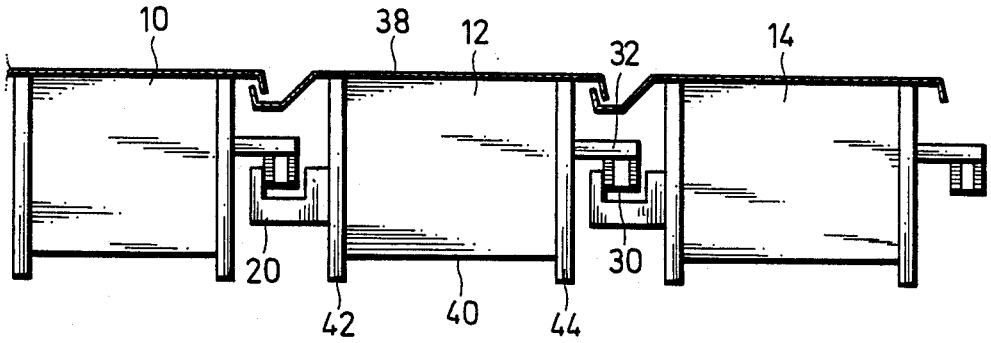
FIG. 2 is a section along the line II—II of FIG. 1.

FIG. 2 shows a cross section through the knives 10 to 14. The knives consist of an upper wall 38 and a lower wall 40, which are connected with each other by side walls 42 and 44. On the side wall 42 there is a guide yoke 20, and a wedge element 30 on the side wall 44 is fastened via a cantilevered plate 32.

Figure 3:
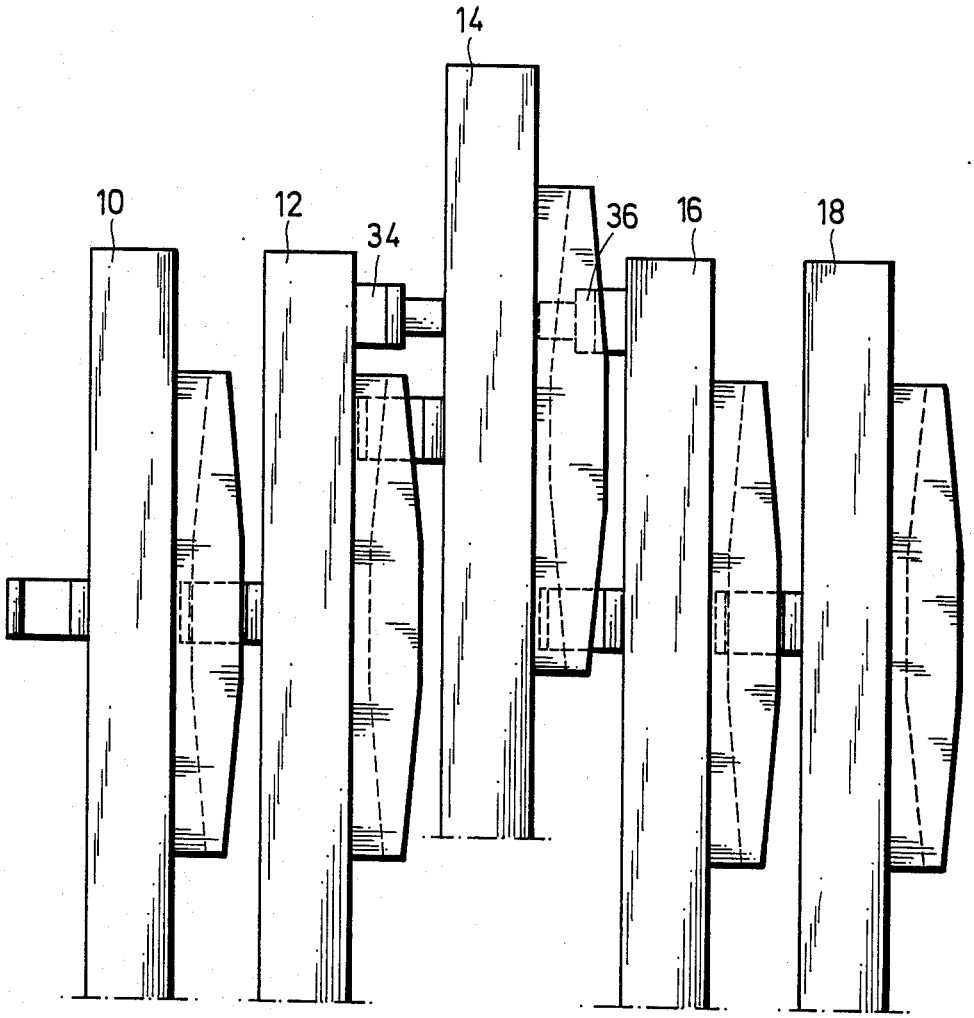
FIG. 3 shows the arrangement of FIG. 1 with one drive knife advanced parallel to the other drive knives.

FIG. 3 shows the arrangement of FIG. 1 with the knife 14 advanced via a hydraulic press (not shown) with respect to the knives 10, 12, 16 and 18. Since the hydraulic presses 34 and 36 are acted on simultaneously, the knife 14 is advanced parallel to the other knives.

Figure 4:
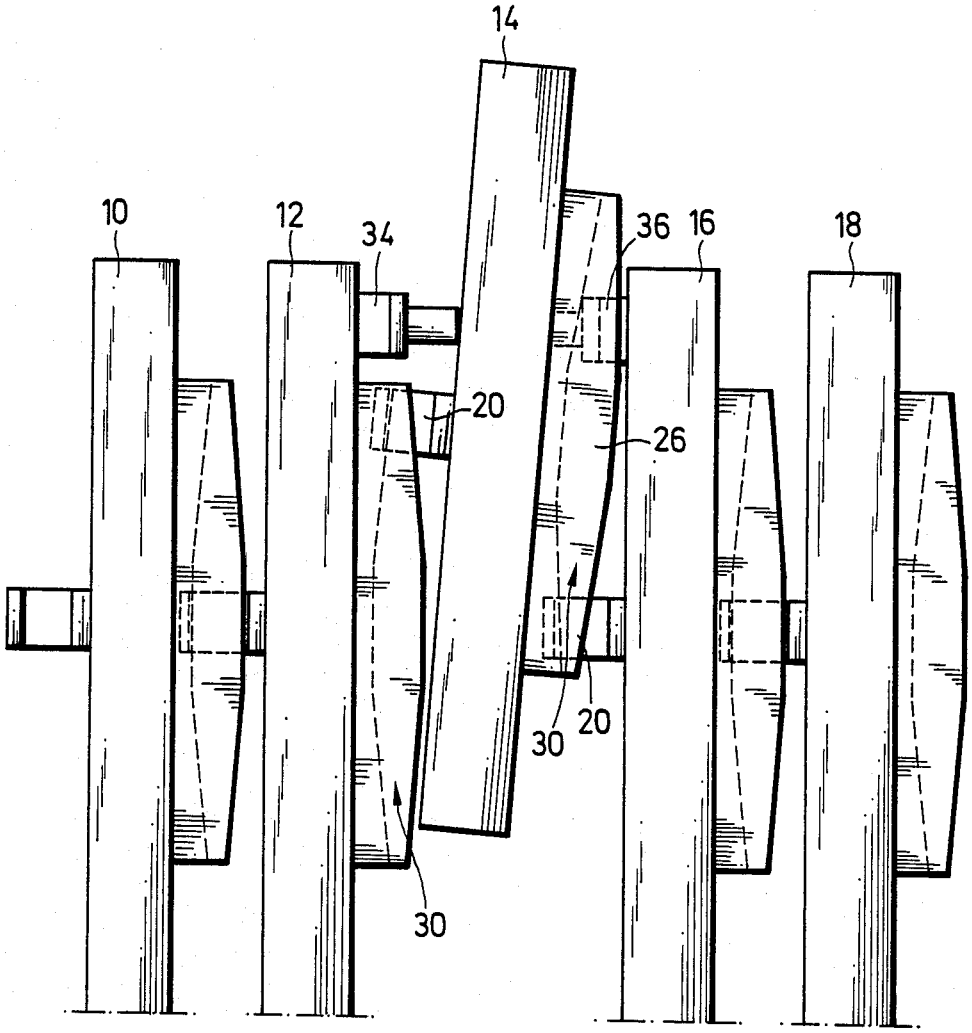
FIG. 4 shows the arrangement of FIG. 1 with one knife advanced obliquely with respect to the other drive knives.

FIG. 4 shows the arrangement of FIG. 1 in which the knife 14 has been advanced obliquely with respect to the knives 10, 12, 16 and 18. Since after an advancing distance which corresponds approximately to the length of the central section 26 of the wedge element 30, the wedge surface has play in the U-shaped yokes, the knife 14 can be swung to the right by the moving outward of the piston of the hydraulic press 34 and the corresponding moving inward of the piston of the hydraulic press 36. In this connection, the outer arm of the yoke 20 arranged on the left-hand side slides on the inner oblique surface of the wedge surface arranged on the right-hand side of the knife and the rear inner wedge surface of the wedge element 30 on the right-hand side of the drive knife 14 slides on the outer arm of the yoke 20 which is arranged on the left-hand side of the knife 16.

After the knife 14 has reached its desired end position, the hydraulic pressure cylinders on the knives 12 and 16 are removed and, commencing with the knife 12, the knives arranged to the left of the knife 14 are advanced one after the other, an automatic aligning of the knife 12 parallel to the knife 14 taking place by the sliding of the wedge element on the knife 12 in the yoke on the knife 14.

In the same way an alignment takes place of the knife 10 with respect to the knife 12. Similar to the driving of the knives 12 and 10 and possibly other knives, a driving takes place of the knives present to the right of the knife 14, starting from the knife 16. The yoke of this knife slides on the wedge element 20 on the knife 14 until the outer arm of the yoke rests against the central section of constant width of the wedge element and the knife 16 thus assumes a parallel position with respect to the knife 14. The movement of the knife 18 and of any knives possibly adjoining this knife takes place in corresponding manner.

Therefore, at the start of the driving of the knives a guide knife is determined as a function of the circumstances. This guide knife is pushed forward first and it is pushed forward in the desired direction by means of hydraulic presses which are arranged on adjacent knives. There then takes place an advance of the knives continuously to the right and left of the guide knife. In this connection, the U-shaped guides arranged on the one side of the knife cooperate with the wedge element fastened on the neighboring knife so that the knife moving forward in each case is automatically aligned on the knife which has already moved forward and comes into a position parallel to the latter. It is accordingly sufficient merely to move any one knife of the entire knife shield in the desired direction. All knives located to the right and left of this guide knife are then automatically brought, upon the advancing, into the position determined by the guide knife, without any realignment of knives which have moved away having to be effected.

Figure 5:
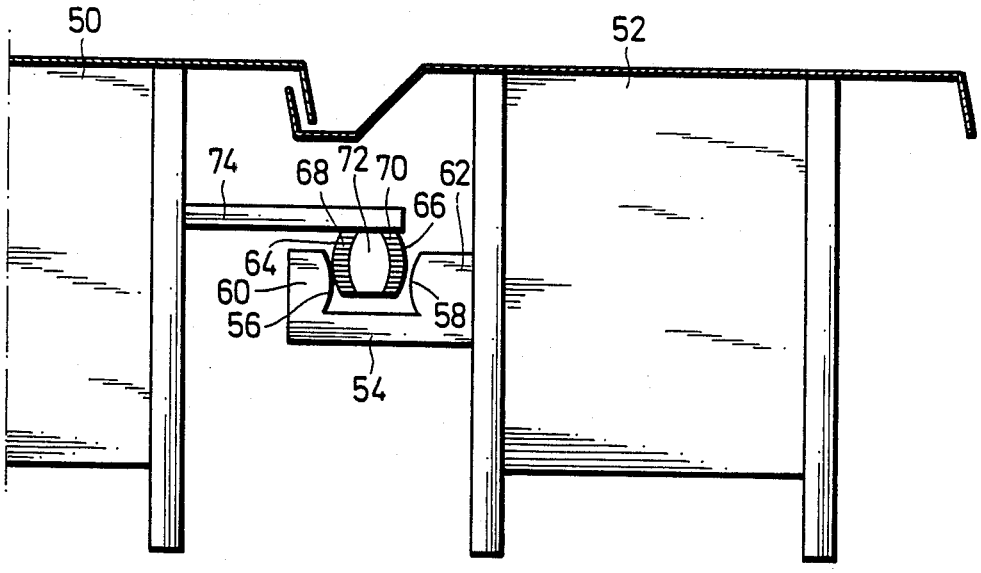
FIG. 5 is a cross section through two drive knives, seen on a larger scale.

FIG. 5 shows a cross section through two knives 50 and 52. In the case of the guide yoke 54 arranged on the left side surface of the knife 52 the inner surfaces 56 and 58 of the upward-directed arms 60 and 62 respectively are rounded. The outer surfaces 64 and 66 of wedge surfaces 68 and 70 respectively of a wedge element 72 are also rounded in order to reduce frictional forces and crowding between the yoke 54 and the wedge element 72. The wedge element 72 is iastened to the knife 50 via a cantilevered plate 74.

Figure 6:
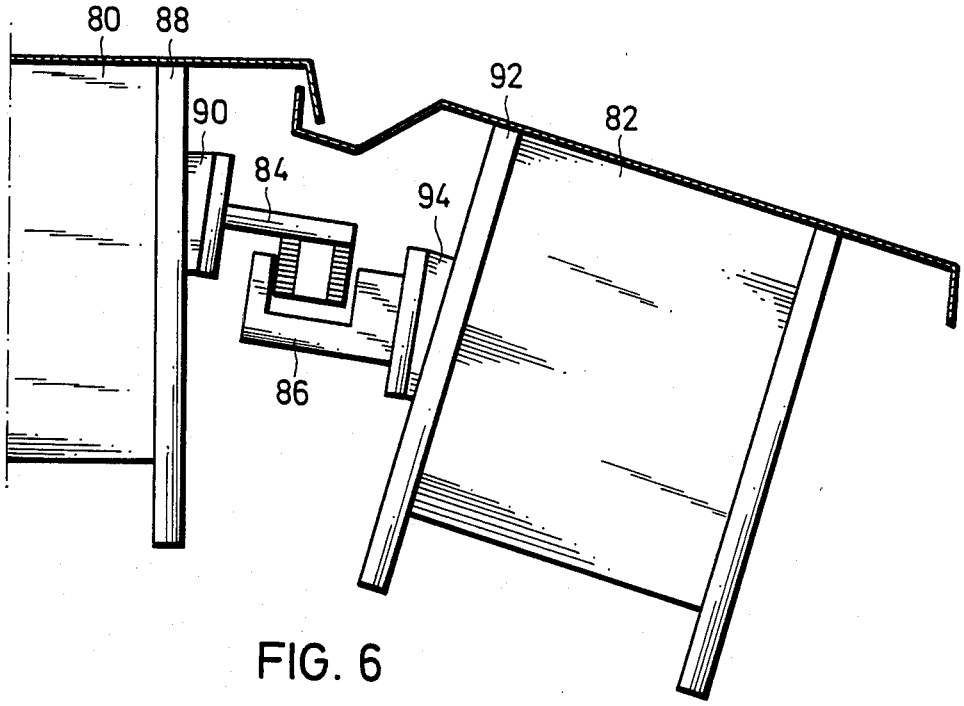
FIG. 6 is a cross section through two drive knives lying in the region of a curve, seen on a larger scale.

FIG. 6 shows a cross section through two knives 80, 82 which are arranged in the region of a curve of a tunnel cross section. A wedge element 84 is fastened to the knife 80 and a guide yoke 86 to the knife 82. Between the wedge element 84 and the side wall 88 of the knife 80 there is arranged a backing wedge 90 and between the side wall 92 of the knife 82 and the guide yoke 86 there is arranged a backing wedge 94, thus obtaining the result that the contact surfaces of guide yoke 86 and wedge element 84 extend parallel to each other although the knife 82 is arranged swung to the knife 80.

In the arrangements shown in the figures, a guide yoke is arranged on one side of each knife and a wedge element on the other side of each knife. However, it is also possible to provide wedge elements on both sides of a knife and correspondingly provide only guide yokes on both sides of adjacent knives. The stocking and replacement of knives which have a guide yoke on one side and a wedge element on the other side is, however, simpler and therefore is to be preferred.

Figure 7:
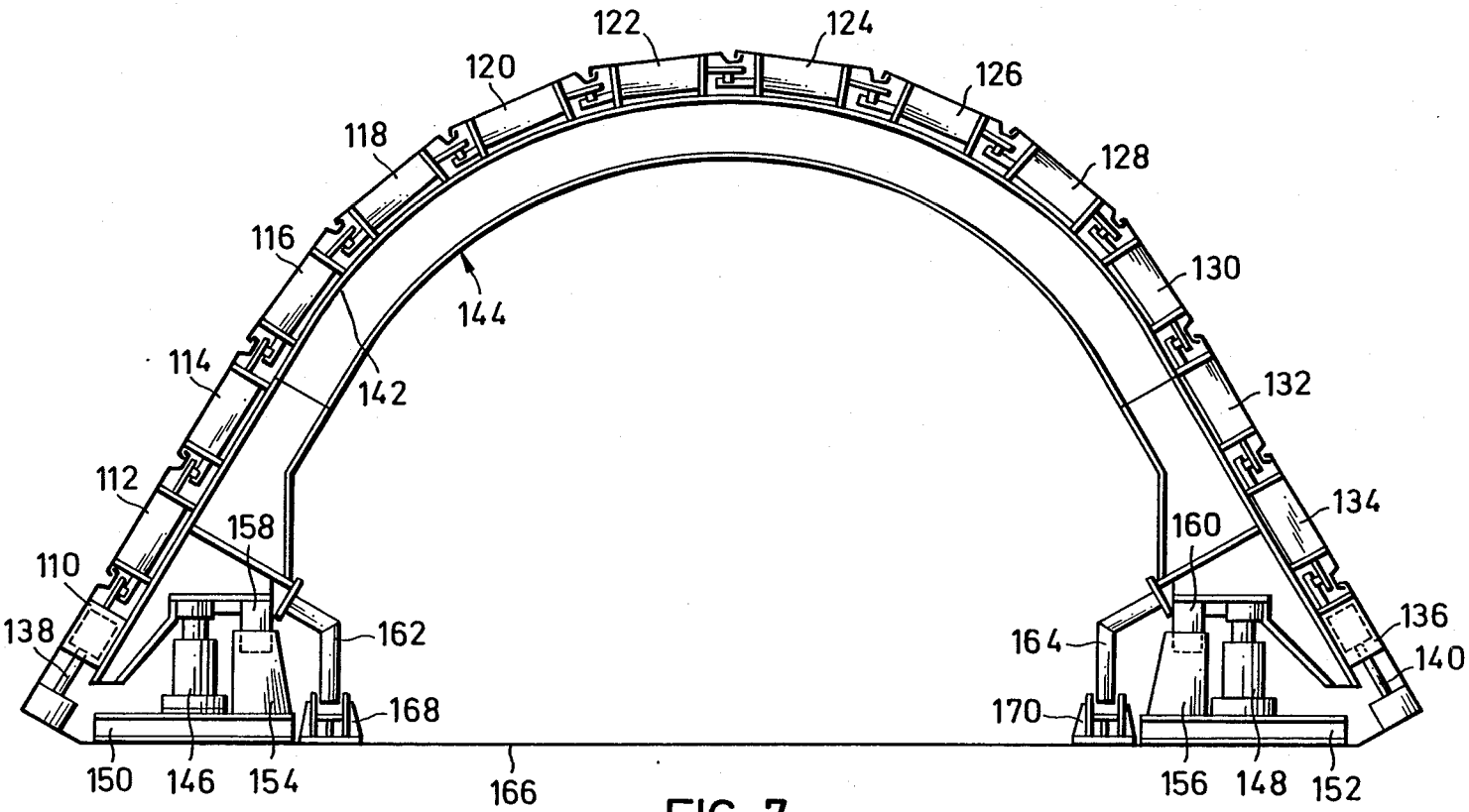
FIG. 7 is a view of the rear side of another embodiment of a device consisting of drive knives and a support device.
Figure 8:
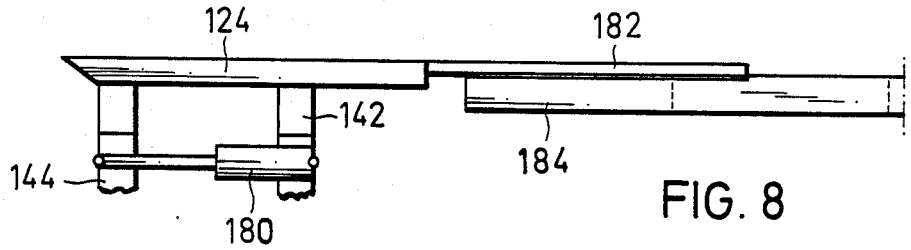
FIGS. 8–11 show the device of FIG. 7 in different successive operating stages.
Figure 9:
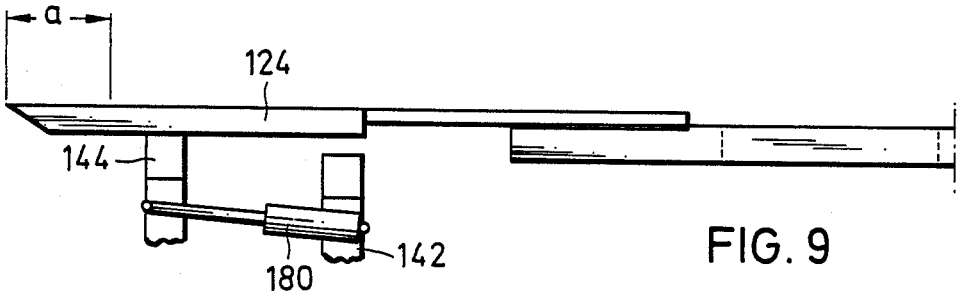
Figure 10:
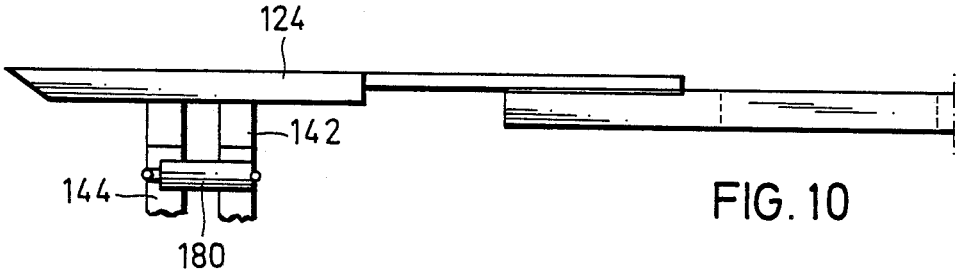
Figure 11:
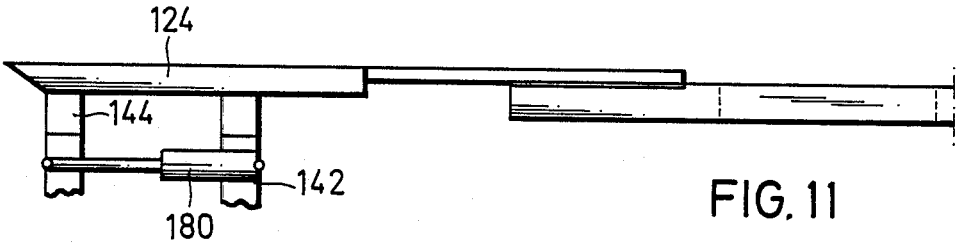

The device shown in FIG. 7 for the excavating and the supporting in the excavating and/or final supporting region consists of knives 110 to 136 which are connected displaceable with respect to each other on their longitudinal side and form the shape of a hood. On the floor-side knives 110 and 136 there are provided lift devices 138 and 140 respectively, in the form of hydraulic piston-cylinder units. During the advance of the knives 110 to 136 the knives are supported via two supporting arches 142, 144. The guide arch 144 lies in front of the guide arch 142 in the direction of advance. On the floor-side ends of the guide arch 142 (as well as of the guide arch 144) there are arranged lift devices 146, 148 in the form of piston-cylinder units. The units 146 and 148 are fastened on floor plates 150, 152 on which guide cylinders 154, 156 are arranged. Into these guide cylinders 154 and 156 there engage guide pins 158, 160 which are fastened to the ends of the supporting arch. By means of the guides and the floor plate, horizontal forces can be discharged into the floor. On the floor-side ends of the guide arch 142 there are arranged, bent of at an angle, supporting braces 162 and 164 respectively whose lower ends lie above rails 168, 170 laid on the floor 166. When the supporting arch 142 is lowered, the ends of the braces 162 and 164 come into contact with the rails 168 and 170 while at the same time the plates 150 and 152 are raised together with the guide cylinders 154 and 156 by the inward movement of the pistons of the piston-cylinder units 146 and 148. In this condition the guide arches 142 and 144 can be moved in the direction of advance in order, at the new locations, again by the moving out of the pistons of the piston-cylinder units 146 and 148, to lower the plates 150 and 152 onto the floor 166 and raise the guide arches 142 and 144 until they come into contact with the bottom of the knives 110 to 136. During the lowering and the travel of the guide arches 142 and 144, the knives 110 to 136 are self-supporting, i.e. by their mutual connection at the longitudinal edges, rock-pressure forces are transmitted into the floor-side knives 110 and 136 and there, via the piston-cylinder units 138 and 140, into the floor. With the device according to the invention, only two guide arches or support frames are necessary, since when the system is at rest, i.e. when all knives 110 to 136 have been driven forward, the knives are self-supporting and take up the rock pressure and transmit it into the floor.

FIGS. 8 to 11 show the difierent steps during the excavating of a tunnel with simultaneous final supporting. The support frames or guide arches 142 and 144 which are connected with each other via piston-cylinder units 180 are arranged in a position below the knives 110 to 136 (the knife 124 is shown), from which position the knives are driven forward for the further excavating. The ends 182 of the knives at the same time form the framework for the supporting 184. In the position shown in FIG. 9 all knives are advanced by the amount a, so that the support frame 142 is at the end of the knives. By actuating the piston-cylinder units on the floor-side ends of the arch 142 the latter is lowered, the knives 110 to 136 simultaneously supporting each other and becoming self-supporting. By the inward movement of the piston of the piston-cylinder unit 180 the guide arch 142 is pushed towards the guide arch 144. In the next possible position of the guide arch 142 with respect to the guide arch 144 the piston-cylinder units of the guide arch 142 are again actuated and the guide arch 142 lifted, it coming into contact with the bottom of the knives 110 to 136. The guide arch 144 is then lowered and pushed by the moving out of the piston of the piston-cylinder unit 180 in the forward direction until it comes below the front end of the knives. From FIG. 11 there can be noted the position in which the guide arch 144 is again raised so that, together with the guide arch 142, it can take over the guiding of the knives which are again to be driven forward. As can be noted from FIGS. 8 to 11, the guide arches 142 and 144 are located alternately in a supporting position and a traveling position. The support elements arranged between the individual knives are only active when all knives 110 to 136 of the hood have been displaced and the knife hood at this stage takes over the function of a self-supporting unit. During the advance of the knives the self-supporting function of the knife hood is done away with so as to permit the relative movement of the knives with respect to each other in the circumferential direction of the knife hood which is necessary for travel around curves and corrections of direction.

Figure 12:
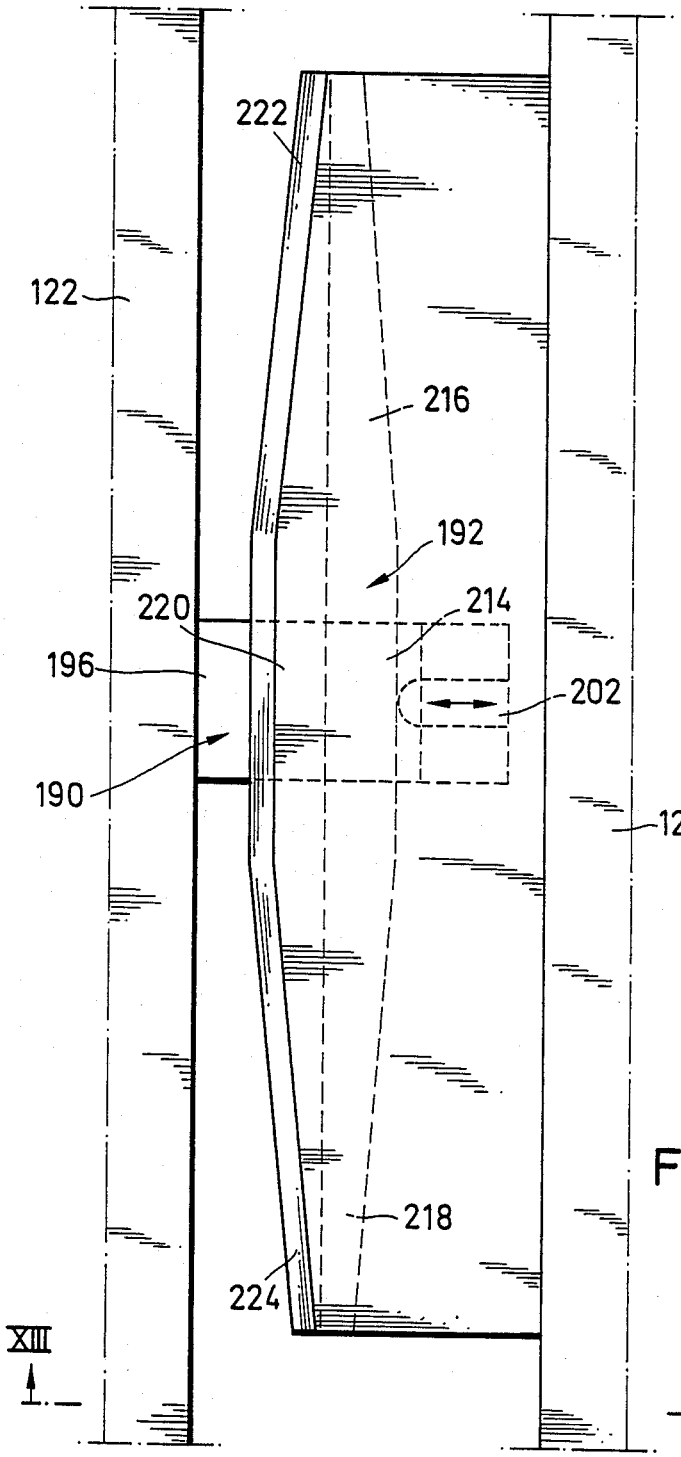
FIG. 12 is a top view of two adjacent knives of the device according to FIG. 7.
Figure 13:
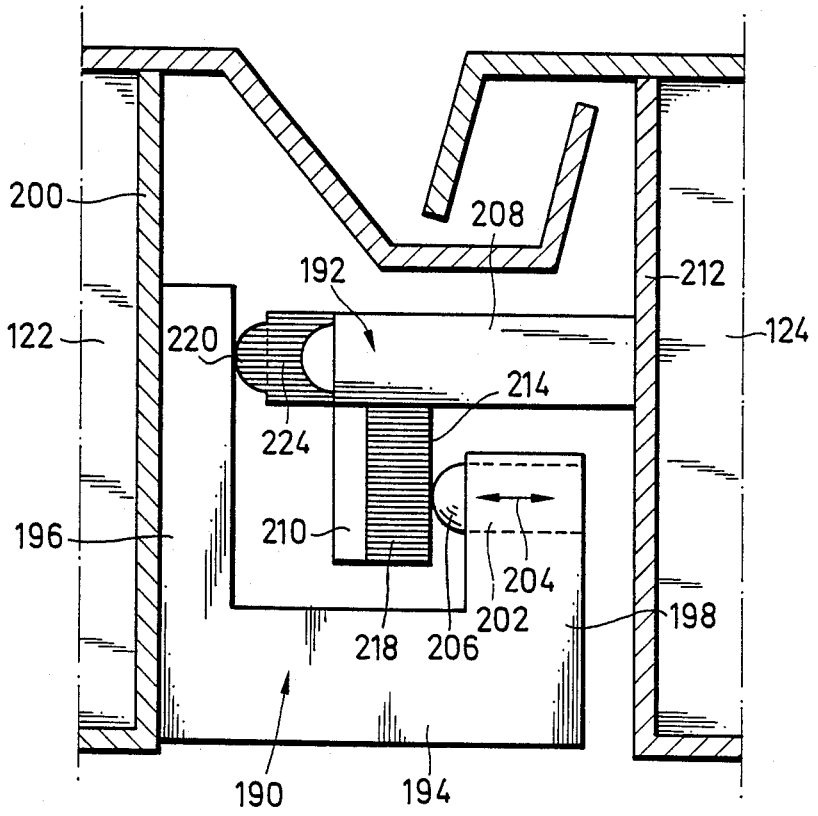
FIG. 13 is a section along the line XIII—XIII of FIG. 12.

The development of the interconnection of the knives on the longitudinal sides can be noted from FIGS. 12 and 13. FIG. 12 is a top view, for instance, of the longitudinal edges of the knives 122 and 124 which are arranged alongside of each other. Approximately in the region of the position of the guide arch 144 in FIG. 8 and in the region of the position of the guide arch 142 in FIG. 9, support members 190 and 192 are arranged on the longitudinal sides of the knives 122 and 124 respectively. Each of the knives 110 to 136 is provided, for instance, with a short support member 190 on its right longitudinal side and an elongated support member 192 on its left longitudinal side. Only the floor-side knives 110 and 136 are developed with a corresponding support member merely on one side.

The support member 190 arranged on the right side of the knife 122 is developed with a U-shaped cross section with a web arm 194 and two arms 196 and 198 extending from it. The arm 196 is, for instance, welded onto the longitudinal side wall 200 of the knife 122. In the arm 198 of the support member 190 there is arranged a screw 202 which can be turned in and out, as indicated by the arrow 204. The screw 202 has a hemispherical head 206 in order to come into punctiform contact with the support member 192.

The elongated support member 192 (the length corresponds well to twice the length of advance of the knife) which is of approximately T-shaped development in cross section, with one arm 208 and a cross arm 210 is fastened by one end of the cross arm 208 to the longitudinal side wall 212 of the knife 124, for instance by welding. The cross arm 210 has, on its side directed towards the support screw 202, a region 114 of constant width adjoining which, on both sides, there are run-on ramps 216 and 218 respectively. The free end of the arm 208 has a central region 220 of constant width, adjoining which on both sides there are also run-on ramps 222 and 224 respectively. The region 220 and the run-on ramps 222 and 224 are semicircular in cross section so that a linear loading by the inner side of the arm 196 of the support member 190 is obtained.

The rounded or hemispherical development of the head 206 of the screw 202 as well as the development with semicircular cross section of the run-on ramps 222 and 224 and of the central region 220 permits a well-defined mutual supporting of the knives with respect to each other when knives lie turned with respect to each other in the arch-shaped course of the support frames 142, 144.

If the knife 124 is driven forward while the knife 122 lies at rest on the guide arches 142 and 144, the regions 214 and 220 of constant width of the support member 192 come out of contact with the guide screw 202 and arm 196 respectively of the support member 190, whereby a relatively free mobility of the knife 124 is obtained. In this way, it is possible to control the knife 124 during its advance in such a manner that a deviation of the drive hood from a straight line, i.e. travel around a curve, can be effected. In order to obtain such travel around a curve, an adjustable pushing device is provided on the neighboring knives to the right and left of the knife to be driven first, at the front thereof, so that the direction of drive of the knife traveling forward first can be controlled during its advance. By the arrangement of the run-on ramps and of the regions of constant width, all other knives must positively follow along with the one knife which has been driven forward first and brought into the correct direction, so that after the driving forward of all knives the support members again assume the positions shown in FIGS. 12 and 13 in which the knives are laterally in direct contact with each other so that they can assume their self-supporting function when the supporting frames or guide arches are moved.

Knives or knife-like scaffolding boards with lateral support members and guide arches can also be used in the concreting region of a tunnel in the same way as in the excavating region. By the self-supporting function of the knives or scaffolding planks it is possible to dispense with an interfering support or falsework.

What is claimed is:

1. A knife-shield driving device for excavation and support in an excavating and/or final support region of galleries, tunnels, shafts or similar elongated structures having a floor side, said device comprising drive knives which can be acted on via a pushing device, the drive knives having guides, and being guided with respect to each other on their longitudinal sides and said device further comprising guide arches which support the knives, characterized by the fact that the guides on the drive knives (10–18) comprise a wedge element (30) on one side of each said knife and a yoke (20) on the opposed side thereof, such that the wedge element (30) of each said knife is guided in the yoke (20) of the knife adjacent thereto for achieving parallel positioning of said knives (10–18) relative to one another.

2. A knife-shield driving device according to claim 1, characterized by the fact that the yokes are of U shape and comprise a pair of spaced apart arms (26 28), and that on the wedge element (30) there is provided a section having a width which corresponds approximately to the distance between the arms (26 28) of the U shaped yoke (20).

3. A knife-shield driving device according to claim 2, characterized by the fact that the wedge elements (30) taper towards both ends starting from a section of constant width developed as central section.

4. A knife-shield driving device according to claim 2, characterized by the fact that the U-shaped yoke (20) is open on the top and that the wedge element (30) engages from above between the arms (26, 28) of the yoke.

5. A knife-shield driving device according to claim 1, characterized by the fact that the wedge element (30) is fastened via a cantilever plate (32) to a longitudinal side of the drive knife (10–18).

6. A knife-shield driving device according to claim 5, characterized by the fact that within a region of curvature of a tunnel cross section, backing wedges (94, 90) are arranged between the U-shaped yoke (86) and the side wall of the drive knife (82), and between the wedge element (84) and the side wall (88) of the drive knife.

7. A knife-shield driving device according to claim 2, characterized by the fact that the contacting inner surfaces (56, 58) of the yoke arms (60, 62) and the outer surfaces (64, 66) of the wedge element (72) are rounded.

8. A knife-shield driving device according to claim 1, characterized by the fact that in the front region of each drive knife (10–18) there is provided a fastening device for a pushing device (34, 36) which acts on an adjacent drive knife.

9. A knife-shield driving device according to claim 1, characterized by the fact that the guides (22, 24) of the wedge elements (30) are of the same length.

10. A knife-shield driving device according to claim 1, characterized by the fact that knives (110 to 136) are arranged in the form of a hood, and that the knives (110 to 136) rest when the device is at rest, against each other via lateral support members, and are self-supporting without any connection on the floor side.

11. A knife shield driving device according to claim 10, characterized by the fact that on one side of each knife (110 to 136) there is arranged a long support member (192) of T-shaped cross section with downward directed transverse arm, (210) and on the other side of each knife there is arranged a short support member (190) of U-shaped cross section with upward-directed arms (196, 198), that the T-shaped support member (192) of one knife (124) engages into the U-shaped support member (190) of an adjacent knife (122), and that wedge-shaped run-on ramps (216, 128; 222, 224) are arranged on the T-shaped support member (192) starting from central sections of constant width (214, 20).

12. A knife-shield driving device according to claim 11 characterized by the fact that an adjustable contact element (202) is arranged on the U-shaped support member (190).

13. A knife-shield driving device according to claim 12, characterized by the fact that the central section (220) and the run-on ramps (222, 224) of the supporting member (192) and the head (206) of the adjustable contact element (202) of the support member (190) are semicircular in cross section.

14. A knife-shield driving device according to claim 10, characterized by the fact that support members (190, 192) are arranged in the front and rear regions of each knife (110 to 136).

15. A knife-shield driving device according to claim 10, characterized by the fact that lift devices (138, 140) are provided which act on the floor-side knives (110, 136) transverse to the longitudinal direction of the knives.

16. A knife-shield driving device according to claim 10, characterized by the fact that lift devices (146, 148) are provided on the floor-side ends on support frames (142, 144).

17. A knife-shield driving device according to claim 16, characterized by the fact that guide elements (158, 160) which engage in guides (154, 156) arranged on floor plates (150, 152) are arranged on the floor-side ends of the support frames (142, 144).

18. A knife-shield driving device according to claim 17, characterized by the fact that the floor plates (150, 152) are connected to the lift devices (146, 148).

19. A knife-shield driving device according to claim 18, characterized by the fact that braces (162, 164) are provided which engage and are displaceable at the floor-side ends of the support frames (142, 144) in guides (168, 170) which can be laid on the floor (166).

20. A knife-shield driving device according to claim 19, characterized by the fact that two support frames (142, 144) connected by pushing devices (180) are provided.

21. A method for the excavating and/or final supporting of galleries, tunnels, shafts or similar elongated structures, in which connection knives supported by support frames or guide arches are driven forward one after the other and after the driving forward of all knives the support frames advance further with a device according to claim 1, characterized by the fact that with the system at rest or after the advancing of all knives the knives are brought into lateral contact with each other and become self-supporting, that the support frames are lowered and advance further, and that after the lifting of the support frames the knives are again driven forward.

22. A method according to claim 1, characterized by the fact that the knives are supported on both sides on the floor.

* * * * *